US010139147B2

(12) United States Patent
Kang

(10) Patent No.: US 10,139,147 B2
(45) Date of Patent: Nov. 27, 2018

(54) REFRIGERATOR WITH ICE CONTAINER

(71) Applicant: LG ELECTRONICS INC., Seoul (KR)

(72) Inventor: Sungsik Kang, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/497,334

(22) Filed: Apr. 26, 2017

(65) Prior Publication Data

US 2017/0227275 A1 Aug. 10, 2017

Related U.S. Application Data

(63) Continuation of application No. 13/900,041, filed on May 22, 2013, now Pat. No. 9,664,428.

(30) Foreign Application Priority Data

Jun. 20, 2012 (KR) ..... 10-2012-0065968

(51) Int. Cl.

| | |
|---|---|
| ***F25C 5/00*** | (2018.01) |
| ***F25C 5/04*** | (2006.01) |
| ***F25C 5/20*** | (2018.01) |
| *F25C 5/12* | (2006.01) |
| *F25C 5/02* | (2006.01) |

(52) U.S. Cl.

CPC ..... *F25C 5/24* (2018.01); *F25C 5/046* (2013.01); *F25C 5/02* (2013.01); *F25C 5/12* (2013.01); *F25C 2400/08* (2013.01)

(58) Field of Classification Search

CPC .. F25C 5/025; F25C 5/007; F25C 5/12; F25C 5/0046

USPC ..... 62/321, 378, 381, 382

See application file for complete search history.

(56) References Cited

U.S. PATENT DOCUMENTS

| | | | |
|---|---|---|---|
| 3,603,436 | A | 9/1971 | Bartholomew |
| 3,733,094 | A | 5/1973 | Emter |
| 4,489,447 | A | 12/1984 | Umehara |
| 4,972,999 | A | 11/1990 | Grace |
| 5,494,406 | A | 2/1996 | Takada et al. |
| 5,618,237 | A | 4/1997 | Shinjo |
| 6,010,037 | A | 1/2000 | Thompson |
| 6,439,428 | B1 | 8/2002 | Schroeder et al. |
| 7,992,407 | B2 | 8/2011 | Kim et al. |

(Continued)

FOREIGN PATENT DOCUMENTS

| | | |
|---|---|---|
| JP | 2006-017313 | 1/2006 |
| KR | 20-0372950 | 1/2005 |
| KR | 10-2011-0024841 | 3/2011 |

OTHER PUBLICATIONS

Butler information on spring tension pins via website .butlerfasteners.co.uk/pdf/pins/selloc.pdf confirmed per wayback machine for date of Jun. 1, 2011.*

(Continued)

*Primary Examiner* — Orlando E Aviles Bosques
*Assistant Examiner* — Joel Attey
(74) *Attorney, Agent, or Firm* — Ked & Associates, LLP

(57) ABSTRACT

A refrigerator with an ice container is provided, and more particularly, a refrigerator with an ice container, in which ice stored in an ice container may be transferred by gravity, and the ice thus transferred may be discharged in a cubic ice state or a broken ice state.

5 Claims, 19 Drawing Sheets

(56) References Cited

U.S. PATENT DOCUMENTS

| | | | |
|---|---|---|---|
| 2004/0025299 | A1 | 2/2004 | Higano et al. |
| 2011/0048052 | A1 | 3/2011 | Lee et al. |
| 2011/0146335 | A1 | 6/2011 | Jung et al. |

OTHER PUBLICATIONS

Jones whitepaper on hole preperation for press fit pins via website .spirol.com/library/whitepapers/Hole_Preparation.pdf confirmed per wyaback machine for date of Dec. 3, 2008.*
Jones (White Paper): "Hole Preparation for Press Fit Pins" via website https://www.spirol.com/library/whitepapers/Hole_Preparation.pdf; Confirmed per Wayback Machine for date of Dec. 3, 2008.
Butler: Information on Spring Tension Pins via website http://www.butlerfasteners.co.uk/pdf/pins/selloc.pdf; Confirmed per Wayback Machine for date of Jun. 1, 2011.
U.S. Office Action dated Sep. 24, 2015 issued in co-pending U.S. Appl. No. 13/900,041.
U.S. Final Office Action dated Apr. 21, 2016 issued in co-pending U.S. Appl. No. 13/900,041.
European Search Report dated Jun. 13, 2016 issued in Application No. 13169496.0.
U.S. Office Action dated Aug. 26, 2016 issued in co-pending U.S. Appl. No. 13/900,041.
U.S. Notice of Allowance dated Jan. 27, 2017 issued in co-pending U.S. Appl. No. 13/900,041.
Korean Office Action issued in Application 10-2012-0065968 dated Mar. 29, 2018.
Korean Office Action dated Sep. 11, 2018 issued in KR Application No. 10-2012-0065968.

* cited by examiner

REFRIGERATOR WITH ICE CONTAINER

CROSS-REFERENCE TO RELATED APPLICATION(S)

This application is a Continuation Application of prior U.S. patent application Ser. No. 13/900,041 filed May 22, 2013, which claims priority to Korean Patent Application No. 10-2012-0065968, filed in Korea on Jun. 20, 2012, which is hereby incorporated by reference as if fully set forth herein.

BACKGROUND

Field

A refrigerator with an ice container is disclosed herein.

Background

Refrigerator with ice containers are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. Wherever possible, like reference numbers have been used throughout the drawings to indicate the same or like parts, and repetitive disclosure has been omitted.

A refrigerator is a domestic appliance for storage of refrigerated or frozen objects using a refrigerating cycle of compression, condensing, expansion, and evaporation. Such a refrigerator may include a body having at least one storage chamber, at least one door on the body to open/close the body, and an ice maker provided in the storage chamber or the door. The ice container may be provided on the storage chamber or the door to hold ice from the ice maker. Further, the ice container may be connected to a dispenser to dispense the ice to a user upon user's selection.

The ice container may be provided with an ice breaker to dispense broken ice to the user. The ice breaker may be provided with a rotational shaft connected to a motor, a plurality of rotary blades reversibly mounted to the rotational shaft, and a plurality of fixed blades arranged between the plurality of rotatable blades, respectively. The plurality of rotary blades and the plurality of fixed blades may be spaced predetermined distances from one another with spacers placed on the rotational shaft together with the blades. In such a case, the rotational shaft may have a screw fastened to an opposite end of the motor.

The ice breaker may be connected to a reversible motor to dispense broken ice when the rotational shaft is rotated in one direction and cubic ice when the rotational shaft is rotated in the other direction. However, as the motor is reversible, the screw fastened to the one end of the rotational shaft is liable to be loosened.

Figure 1:
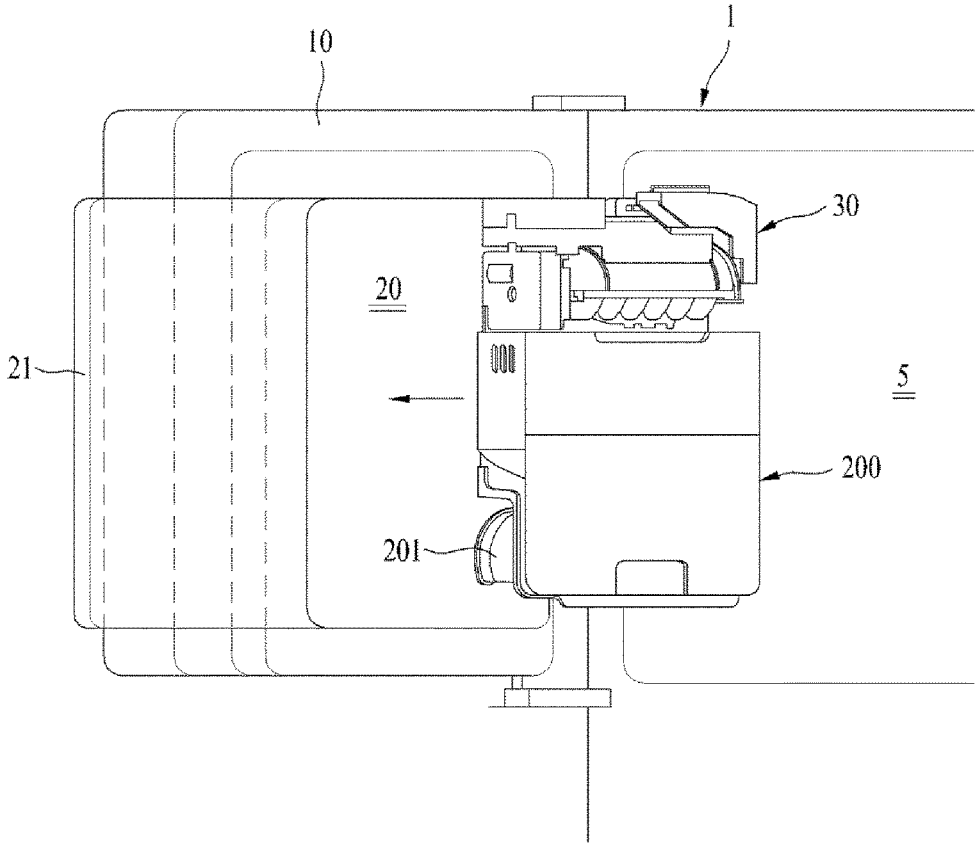
FIG. 1 is a schematic view of an ice container and an ice maker mounted to an inside of a door of a refrigerator in accordance with an embodiment.

FIG. 1 is a schematic view of an ice container and an ice maker mounted to an inside of a door of a refrigerator in accordance with an embodiment. Referring to FIG. 1, the refrigerator according to this embodiment may include a body 1 having at least one storage chamber 5, and at least one door 10 rotatably mounted to the body 1 to open/close the storage chamber 5. An ice making chamber 20 provided with an ice maker 30 to make ice and an ice container 200 to hold the ice from the ice maker 30 may be provided to or at an inside of the door 10.

A motor 201 to drive an ice conveyer 300 (see FIG. 2) in the ice container 200 may be provided in or at a rear of the ice container 200. An ice making chamber door 21 to open/close the ice making chamber 20, selectively, may be mounted to or at one side of the ice making chamber 20.

Figure 2:
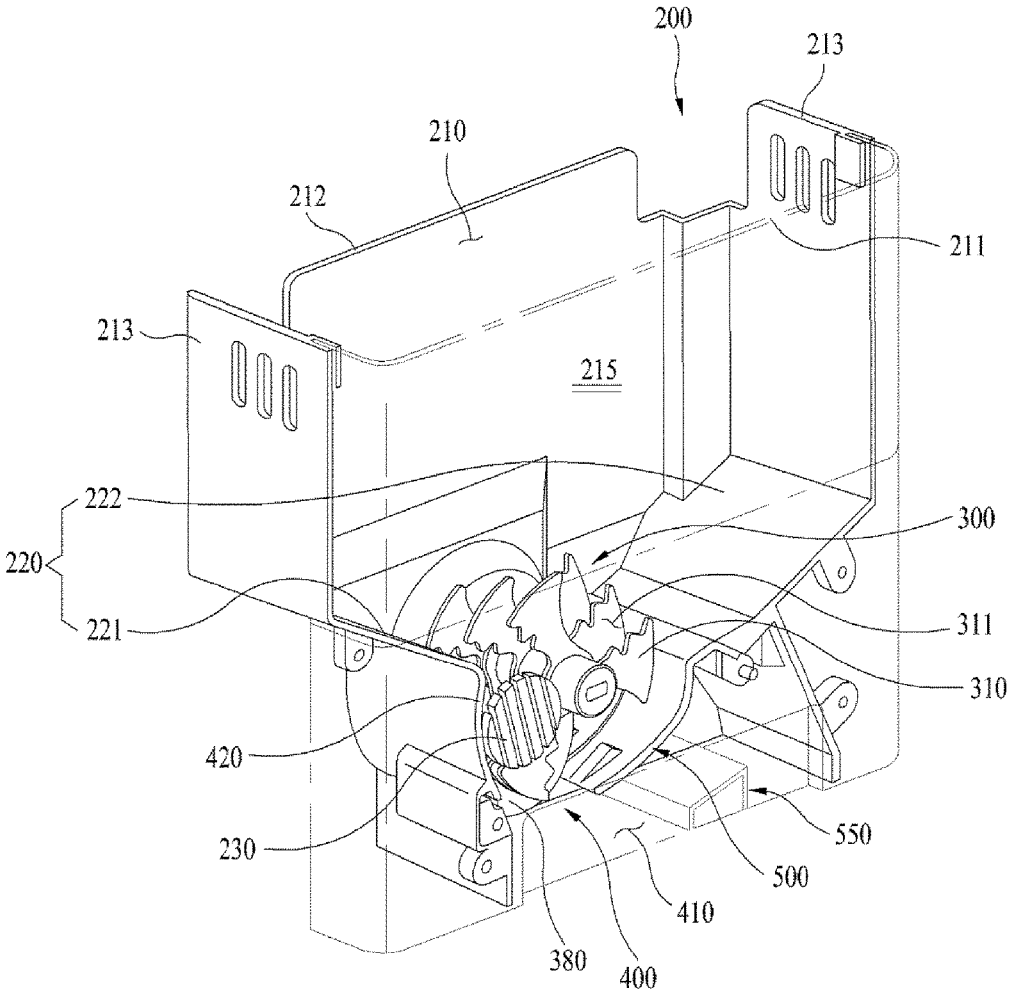
FIG. 2 is a perspective view of an ice container in a refrigerator in accordance with an embodiment.

Referring to FIG. 2, the ice container 200 may have an open upper portion 210, a front wall 211, a rear wall 212, and sidewalls 213. The ice container 200 may also have a sloped guide surface 220 to support the ice held therein, as well as guide the ice held thus to slide down by gravity. The front wall 211, the rear wall 212, the sidewalls 213, and the sloped guide surface 220 may form an ice holding space 215 to hold the ice.

The sloped guide surface 220 may have two sloped guide surfaces spaced from each other both sloped downward toward a center of the ice container 200. The sloped guide surface 220 may include a first sloped guide surface 221 and a second sloped guide surface 222.

An ice conveyer 300 to convey the ice from the ice container 200 to an outside of the ice container 200 may be provided between the first sloped guide surface 221 and the second sloped guide surface 222. That is, the first sloped guide surface 221 and the second sloped guide surface 222 may be positioned on a first side (in FIG. 2, the left side) and a second side (in FIG. 2, the right side) of the ice conveyer 300. In this case, the ice conveyer 300 may include at least two rotary blades 310, each having a predetermined receiving space 311 to receive the ice. The ice may move toward the ice conveyer 300 from the first sloped guide surface 221 and the second sloped guide surface 222 by gravity, and be discharged to an outside of the ice conveyer 300 as the ice conveyer 300 operates.

The ice conveyer 300 may be reversibly mounted thereto, and a discharge portion 400 having a discharge opening 410 to discharge the ice may be mounted between the first sloped guide surface 221 and the second sloped guide surface 222. At least one fixed blade 380 to break the ice into ice pieces together with the rotary blades 310 of the ice conveyer 300 may be provided to or at one side of a lower side of the ice conveyer 300, that is, one side of the discharge portion 400 if the ice conveyer 300 rotates in a first rotational direction. The at least one fixed blade 380 may include at least two fixed blades 380, and a respective rotary blade 310 may pass through a space between the at least two fixed blades 380. If the rotary blades 310 press the ice with a rotational force of the rotary blades 310 in a state in which the ice is received in a space between the fixed blades 380 and the rotary blades 310, the ice may be broken into ice pieces.

An opening/closing member 500 to provide communication between the discharge opening 410 and the storage space 215, selectively, to discharge the ice in the cubic ice state if the ice conveyer 300 rotates in a second rotational direction, which is opposite to the first rotational direction, may be provided to or at the other side of the lower side of the ice conveyer 300, that is, the other side of the discharge portion 400. In this case, in a state in which the ice is received in the receiving space 311 at the rotary blades 310 of the ice conveyer 300, if the rotary blades 310 rotate, the ice presses the opening/closing member 500. The opening/closing member 500 thus pressed by the ice has an end thereof rotated downward to form a space between the opening/closing member 500 and the rotary blades 310, to allow the ice to be discharged in a direction of the discharge opening 410 and therefrom to a dispenser (not shown) through the space while maintaining the cubic ice state.

An opening limiting portion 550 to limit an opening range of the opening/closing member 500 to prevent the cubic ice from discharging excessively may be provided under the opening/closing member 500. If the ice conveyer 300 rotates in the first rotational direction, the cubic ice may be broken into piece ice and discharged in the piece ice state due to interferential operation of the rotary blades 310 and the fixed blades 380. If the ice conveyer 300 rotates in the second rotational direction, the cubic ice pressed down by the rotary blades 310 may press down to open the opening/closing member 500, allowing the ice to be discharged in the cubic ice state.

The discharge portion 400 may have a wall adjacent to the fixed blades 380 formed to have a shape corresponding or matched to a rotational locus of the rotary blades 310. This may be referred to as a discharge guide wall 420. The discharge guide wall may have an arc-shaped surface having a curvature corresponding or matched to the rotational locus of the rotary blades 310. This may prevent the broken ice pieces from remaining at or in the discharge portion 400 and discharge all of the broken ice pieces to the outside of the discharge portion 400, instantly. In order to prevent the ice from being seized and stagnating between the rotary blades 310 and a front wall of the ice container 200, an ice seizure preventive portion 230 may be provided to or at a rear side of the front wall 211 of the ice container 200 to project toward the rotary blades 310.

Figure 3:
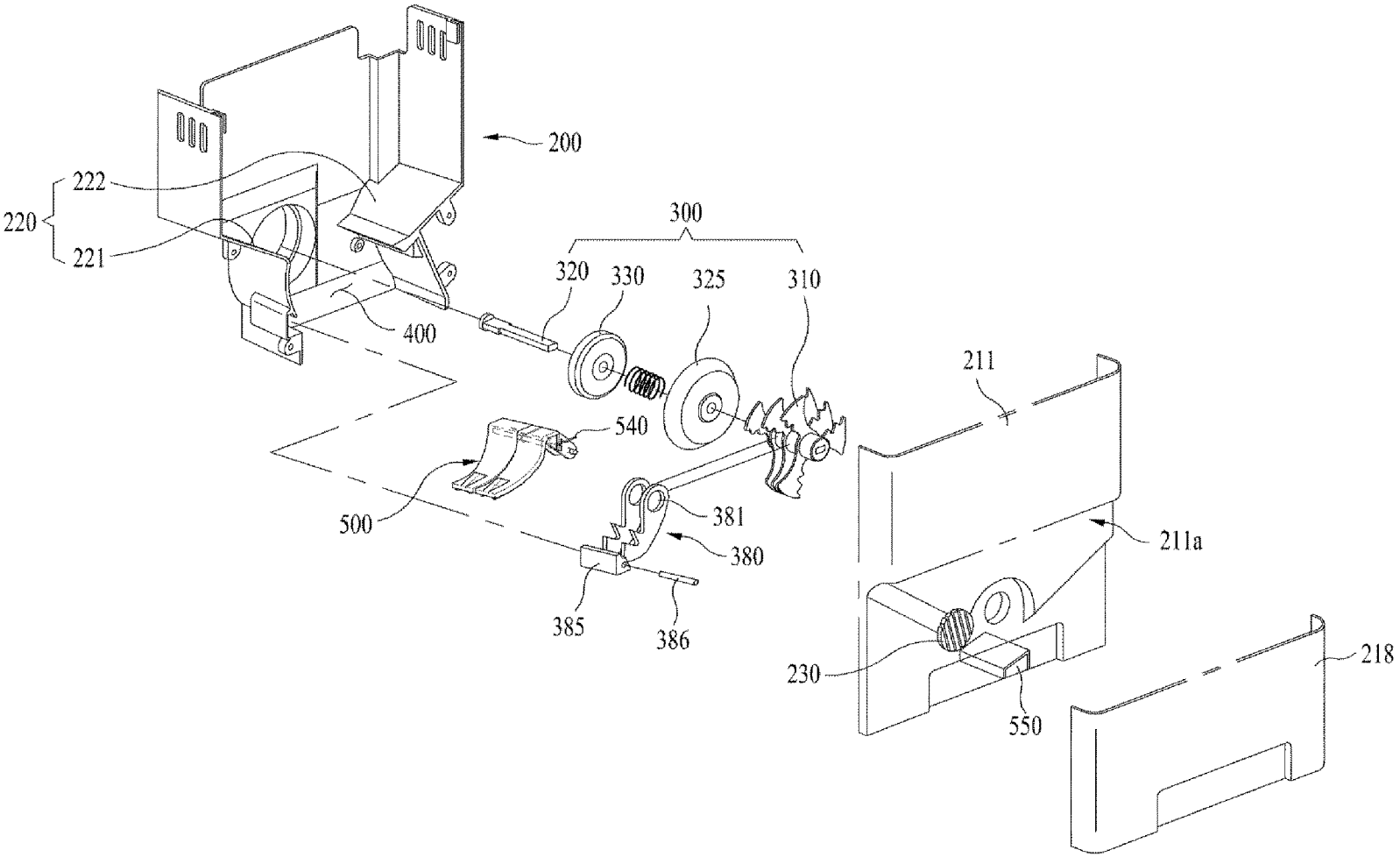
FIG. 3 is an exploded perspective view of an ice container in a refrigerator in accordance with an embodiment.

Referring to FIG. 3, the ice conveyer 300 may have the rotary blades 310 fixedly secured to the rotational shaft 320, and, in turn, the rotational shaft 320 may be mounted to pass through a supporting plate 325 provided in or at a rear of the rotary blades 310 and a connection plate 330 to be detachably coupled to the motor 201 (see FIG. 1). The rotary blades 310 may be arranged at fixed intervals fixedly mounted to the rotational shaft 320 so as to be rotated as the rotational shaft 320 rotates.

As described above, the fixed blades 380 may each have one end thereof mounted to the rotational shaft 320. In this case, the one end of each of the fixed blades 380 may include a pass through hole 381 configured to be placed on the rotational shaft 320. The pass through holes 381 may have a size larger than a diameter of the rotational shaft 320 to prevent the fixed blades 380 from moving even if the rotational shaft 320 rotates, which will be discussed in detail hereinbelow. The one end of each of the fixed blades 380 may be arranged between adjacent rotary blades 310, respectively.

The other end of each of the fixed blades 380 may be fixedly secured to one side wall of the discharge portion 400. To do this, the other end of each of the fixed blades 380 may be connected to a predetermined fixing member 385 which, in turn, may be placed in the one side wall of the discharge portion 400, thereby fixedly securing the fixed blades 380 to the side wall. The fixing member 385 may be arranged to be positioned below the rotational shaft 320, and a pin 386 may be placed in a pass through hole in the fixing member 385 to fixedly secure the other end of each of the fixed blades 280.

A single or a plurality of the opening/closing member 500 may be provided, and arranged on a side of the fixed blades 380. The opening/closing member(s) 500 may be rotatably arranged to or at the discharge portion 400, and may be formed of an elastic material or supported by an elastic member 540, such as spring. Thus, an end portion of the opening/closing member 500 may move downward when the ice presses down the end, and return to an original position if the pressing down action of the ice is removed.

After the ice conveyer 300, the fixed blades 380, and the opening/closing member 500 are mounted to the ice container 200, a front plate 211*a* of the front wall 211 of the ice container 200 may be mounted. A cover member 218 may be mounted to a lower side of a front of the front plate 211*a* to cover the opening/closing member 500 and/or the fixed blades 380 to make the opening/closing member 500 and the fixed blades 380 invisible from an outside of the ice container 200.

Figure 4:
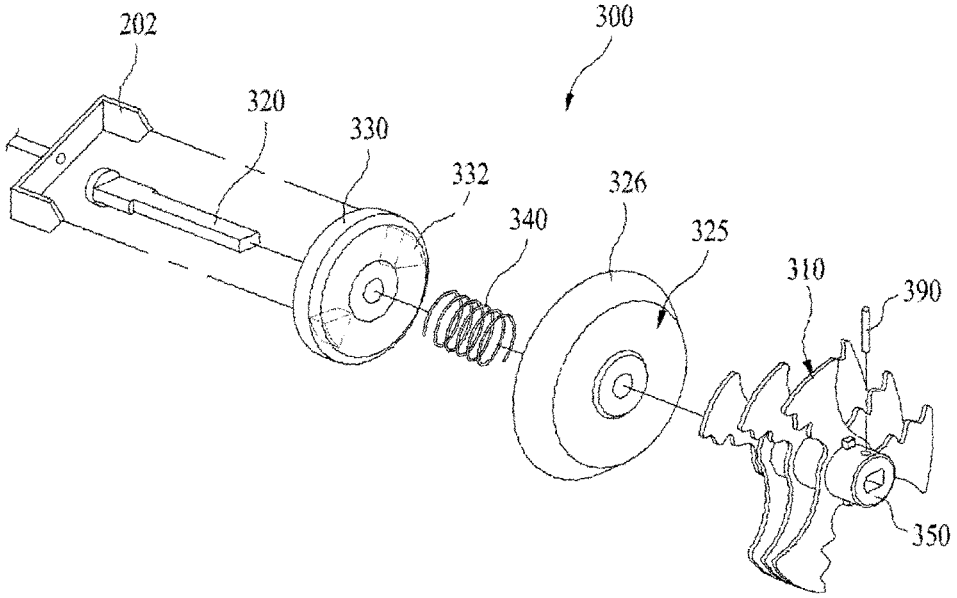
FIG. 4 is an exploded perspective view of an ice conveyer in a refrigerator in accordance with an embodiment.

Referring to FIG. 4, the ice conveyer 300 may include the rotary blades 310, the supporting plate 325, and the connection plate 330 secured to the rotational shaft 320. An elastic member 340, which may be in the shape of a coil spring, to support the connection plate 330, elastically, may be mounted between the supporting plate 325 and the connection plate 330.

By press fitting a pin 390 passed through both a spacer 350 coupled to a front portion of the rotational shaft 320 and the rotational shaft 320 in a state the rotary blades 310, the plurality of fixed blades 380, the supporting plate 325, the connection plate 330, and the elastic member 340 are coupled to the rotational shaft 320, it is possible to prevent the above elements from being loosened and falling off the rotational shaft 320. A fitting method of the pin will be described in more detail hereinbelow.

The rotational shaft of motor 201 (see FIG. 1) may have a hook member 202 to make detachable connection to the connection plate 330, and the connection plate 330 may have one side with catching steps 332 formed thereon to catch the hook member 202 therewith. If ends of the hook member 202 are in contact with land portions, that is, surfaces of the catching steps 332 facing the hook member 202, of the catching steps 332, failing engagement of the hook member 202 with the catching steps 332, driving power of the motor 201 (see FIG. 1) may not be transmitted to the ice conveyer 300 even if the motor 201 is in operation. Therefore, in order to prevent this from happening, if the hook member 202 and the catching steps 332 fail to engage with each other, at first, the connection plate 330 may be moved toward the supporting plate 325. Then, the connection plate 330 may be moved backward by the elastic member 340, to bring end portions of the hook member 202 into contact with side portions of the catching steps 332, thereby making the motor 201 engage with the connection plate 330.

The supporting plate 325 may have a sloped side 326 for the ice to slide smoothly therefrom toward the rotary blade 310. Further, the rotary blades 310 may be spaced a distance from one another, which is smaller than a size of the cubic ice.

Figure 5:
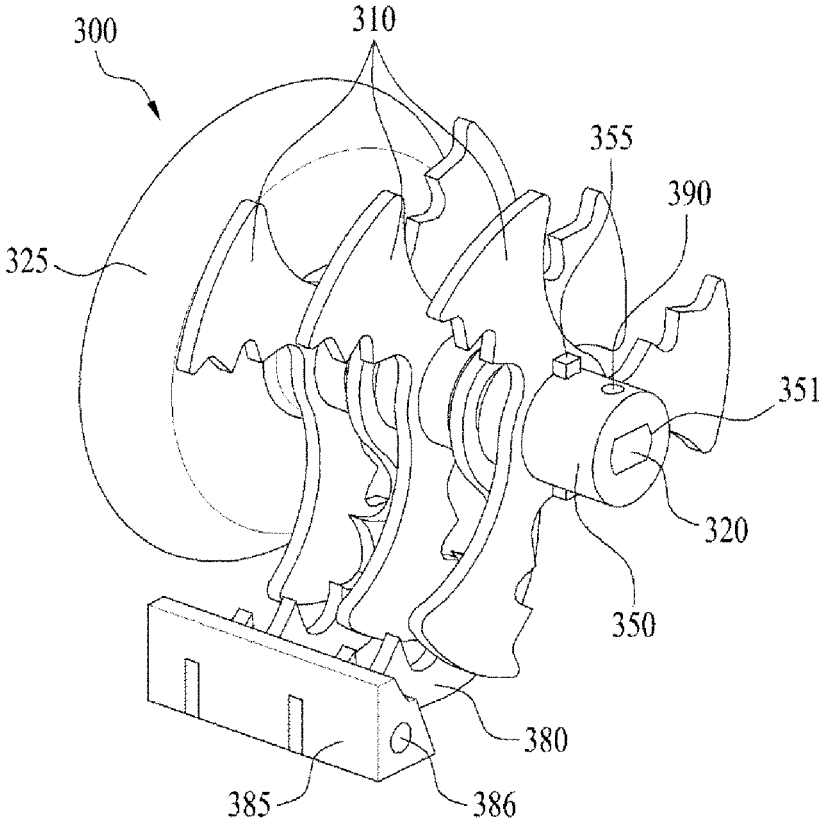
FIG. 5 is a perspective view of an ice conveyer assembly in a refrigerator in accordance with an embodiment.

Referring to FIG. 5, the rotary blades 310 of the ice conveyer 300 may be mounted to be reversible with respect to the rotational shaft 320. The fixed blades 380 may maintain a fixed state despite of rotation of the rotational shaft 320, as one end of each of the fixed blades 380 may be mounted to the rotational shaft 320, and the other end of each of the fixed blades 380 may be mounted to the fixing member 385 which, in turn, may be placed in, and fixedly secured to, the one side wall of the discharge portion 400.

Figure 6:
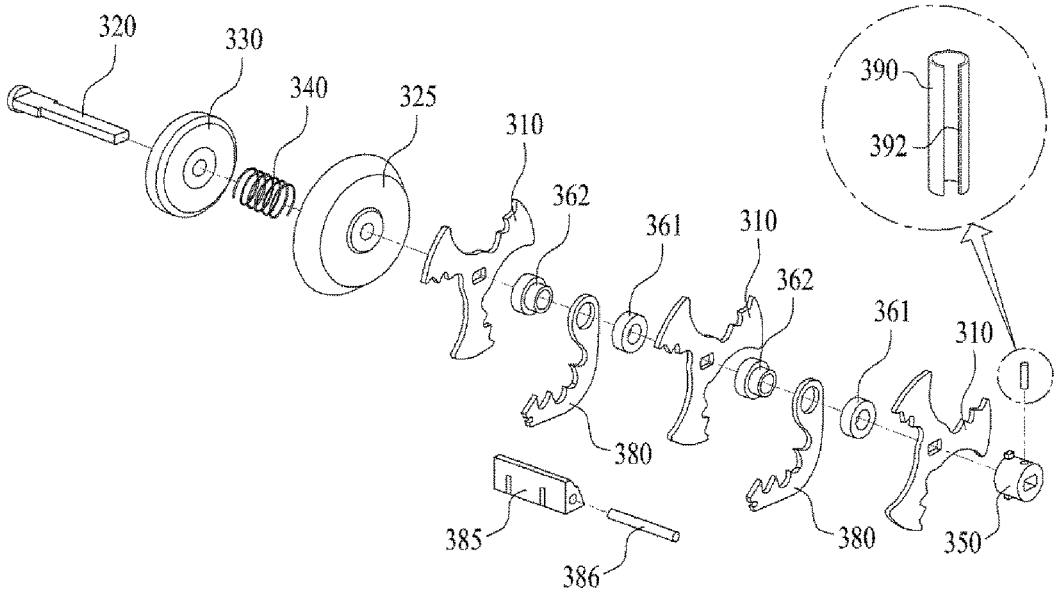
FIG. 6 is an exploded perspective view of an ice conveyer in a refrigerator in accordance with an embodiment, with components thereof disassembled.

Referring to FIG. 6, with this embodiment, the rotational shaft 320 may have a flat shape, and the connection plate 330, the elastic member 340, and the supporting plate 325 may be mounted thereto in order, three rotary blades 310 and two fixed blades 380 mounted thereto alternately, thereafter. Though the embodiment shown in FIG. 6 includes three rotary blades 310 and two fixed blades 380, embodiments are not so limited.

Each of the fixed blades 380 may be arranged between adjacent rotary blades 310, and spacers 361 and 362 may be arranged between adjacent blades 380 and 310 to maintain a predetermined space between the blades 380 and 310. One spacer 362 of the spacers 361 and 362 may have a portion formed to be placed in a shaft hole of the fixed blade 380 to serve also as a bearing. In other words, the fixed blade 380 may be secured to the rotational shaft 320, not by direct contact thereto, but by contact to one side of an outside circumferential surface of the spacer 362.

Mounted to the rotational shaft 320 on or at an outer side of a last rotary blade 310, a spacer 350 may be provided to secure components of the ice conveyer 300 to the rotational shaft 320, and to maintain a predetermined space between the rotary blade 310 and the front plate 211*a*. A pin 390 may be press fit in a hole that passes through both the rotational shaft 320 and the spacer 350 to be coupled to an end portion of the rotational shaft 320. Referring to an enlarged view in FIG. 6, the pin 390 may be, for example, a spring pin having a pipe shape with a lengthwise direction incision. Accordingly, after forming the pin 390 to have a diameter slightly larger than the pass through holes in both the spacer 350 and the rotational shaft 320, the pin 390 may be press fit in the pass through holes, reducing the diameter of the pin 390. The incision 392 of the pin 390 may be formed, for example, by incising a pipe, or by rolling a plate into a circular form.

Figure 7A:
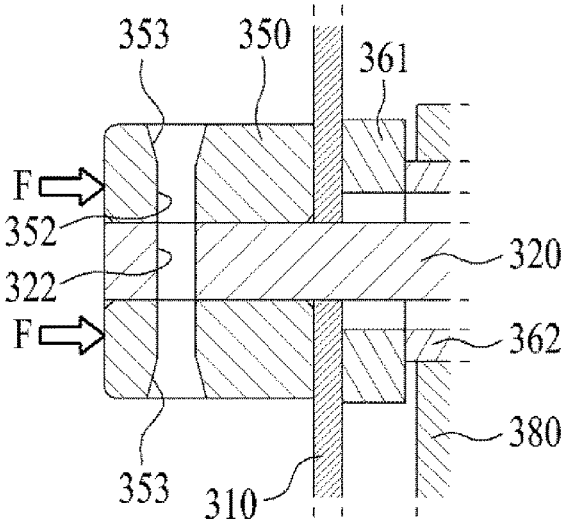
FIGS. 7A-7E are schematic views showing steps of a process to fasten a rotational shaft and a spacer in an ice conveyer in a refrigerator, with a pin, in accordance with an embodiment.

FIGS. 7A-7E are schematic views showing steps of a process to couple a rotational shaft and spacers in an ice conveyer in a refrigerator, with a pin, in accordance with an embodiment. Referring to FIG. 7A, as described above, in order to assemble the ice conveyer 300, components of the ice conveyer 300 may be placed on the rotational shaft 320 in a predetermined order. In such a case, the spacers may be respectively placed between the blades, and spaces therebetween may be set properly. A pass through hole 322 in the rotational shaft 320 and a pass through hole 352 in the spacer 350 may be aligned with each other.

Figure 7B:
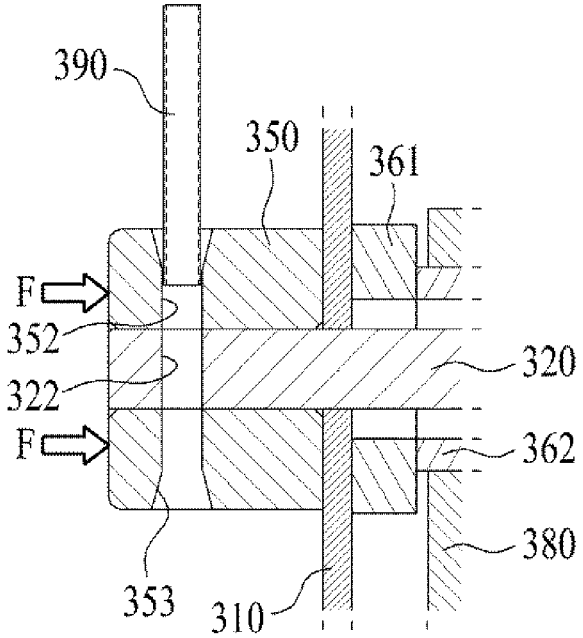
Figure 7C:
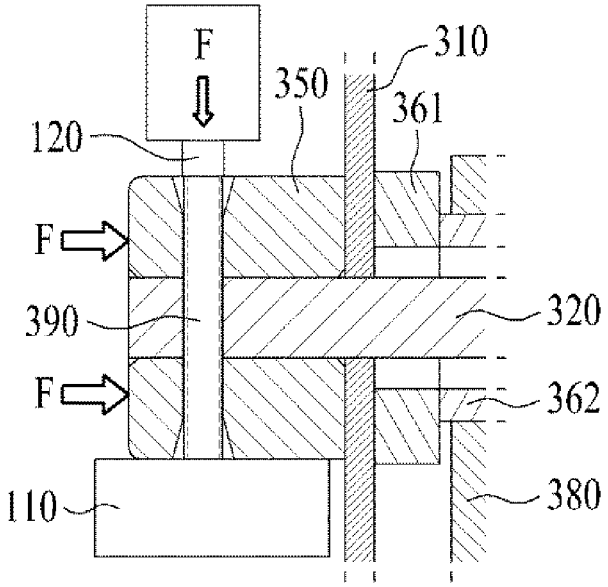

Referring to FIG. 7B, an assembly of the ice conveyer 300 ready to fit or receive the pin 390 may be placed on a jig 110 (see FIG. 7C) in a press (not shown), and the pin 390 may be positioned at an entrance of the pass through hole 352. Then, referring to FIG. 7C, in a state that the jig 110 in the press supports the spacer 350, the pin 390 may be pressed down with a pin insertion projection 120 of the press, to insert the pin 390 into the pass through holes 322 and 352.

Figure 7D:
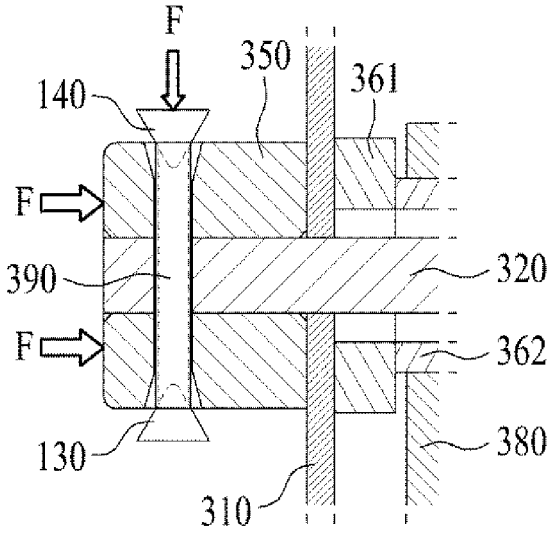

Then, referring to FIG. 7D, a top and a bottom of the pin 390 may be pressed with pin expanding projections 130 and 140 in the press, respectively, to expand the top and the bottom of the pin 390. In such a case, the top and the bottom of the pass through hole 352 in the spacer 350 may have countersinks 353 with enlarged diameters formed therein, respectively, to enable the pin 390 to be enlarged.

Figure 7E:
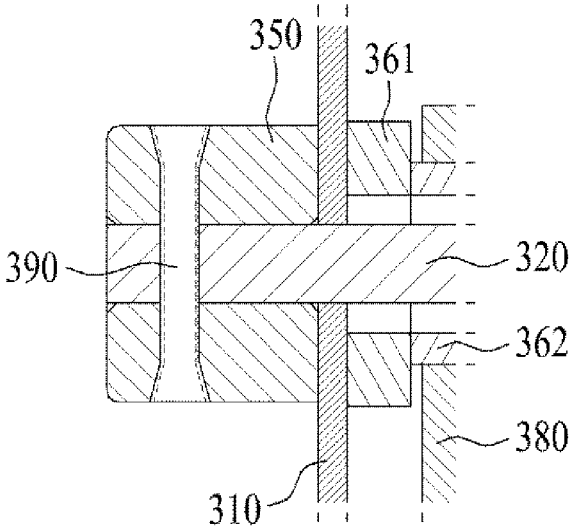

FIG. 7E is a schematic view showing a state in which the pin 390 is inserted, pressed, and enlarged, in the pass through hole 322 in the rotational shaft 320 and the pass through hole 352 in the spacer 350. The pin 390 press fit thus may be prevented from falling off the rotational shaft 320 and the spacer 350 positively, even if the pin 390 is vibrated and an impact is applied thereto, as the rotational shaft 320 reverses repeatedly when the ice conveyer is used.

Figure 8:
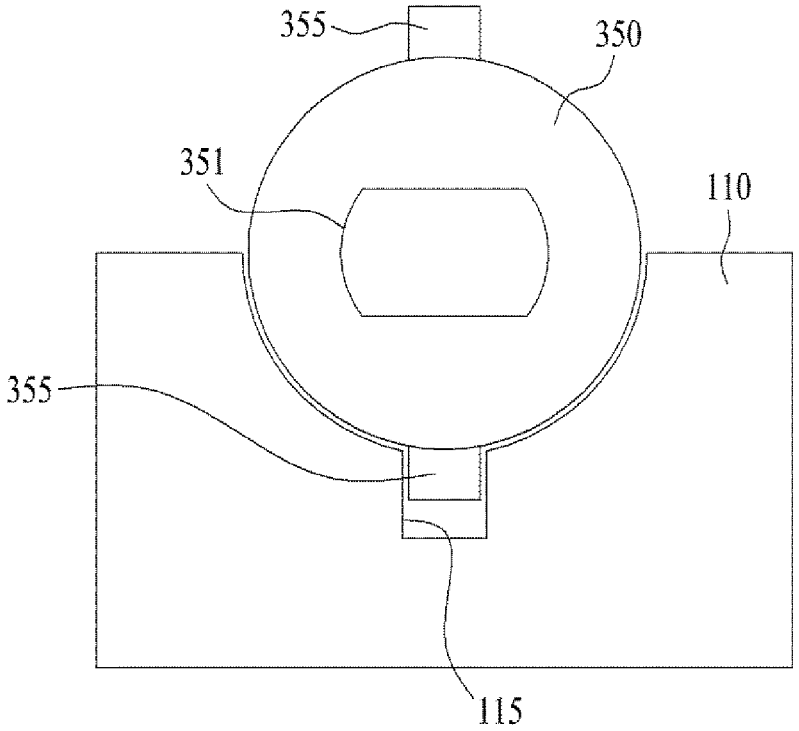
FIG. 8 is a side view showing a state in which a spacer is seated on a jig in the pressing process shown in FIGS. 7A-7E.

FIG. 8 is a side view showing a state in which a spacer is seated on a jig at a time of the pressing process shown in FIGS. 7A-7E. When inserting and pressing the pin 390 as shown in FIGS. 7A-7E, there are cases when the spacer 350 rotates on the jig 110 in the press. Therefore, in order to prevent the spacer 350 from rotating when the pin 390 is being inserted in the spacer 350, the jig 110 may have a hole 115 formed therein, and the spacer 350 may have a projection 355 formed thereon corresponding or matched to the hole 115. According to this, even if a force is applied to the spacer 350 at a point deviated from an axis of the spacer 350 due to, for example, a dimensional error, in the foregoing pressing process, rotation of the spacer 350 may be prevented.

Embodiments disclosed herein provide for press fitting of the pin 390, that is, the spring pin, to fixedly secure the spacer 350 to the rotational shaft 320. In order to prevent the pin 390 from falling off the rotational shaft 320 during use of the ice conveyer 300, first, the spring pin may be inserted by press fitting, and second, both ends of the pin 390 may be expanded after insertion of the pin to fasten the pin 390, more positively. In addition to this, referring to FIGS. 9A and 9B, the pin 390 press fit and having both ends expanded thus may also be prevented from falling off of the rotational shaft 320 by the front plate 211*a* of the ice container 200.

Figure 9A:
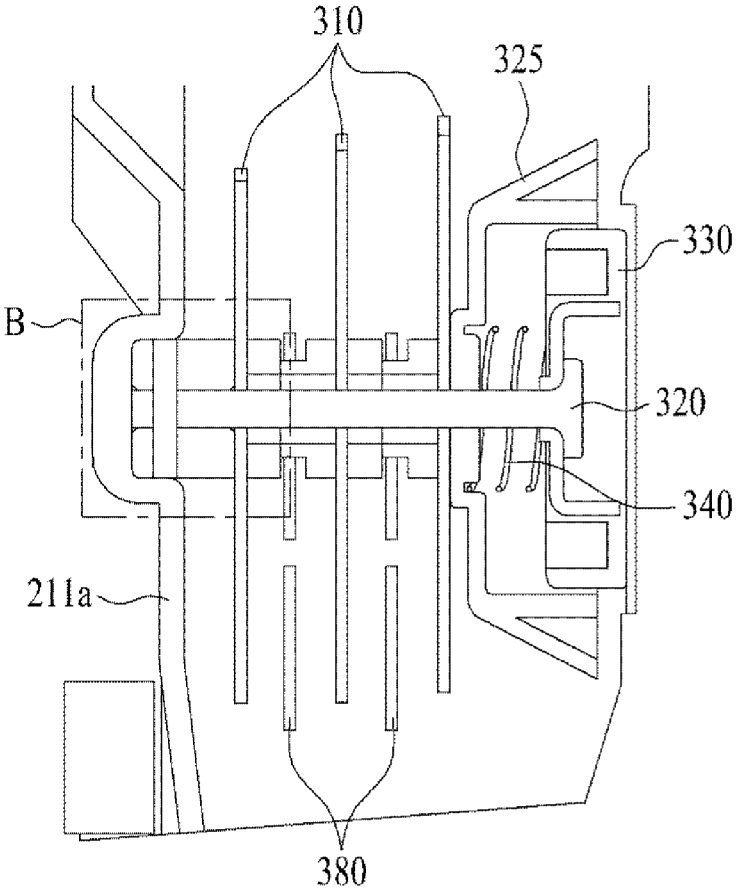
FIGS. 9A and 9B illustrate a partial longitudinal section of the ice conveyer showing the ice conveyer mounted to an ice container.
Figure 9B:
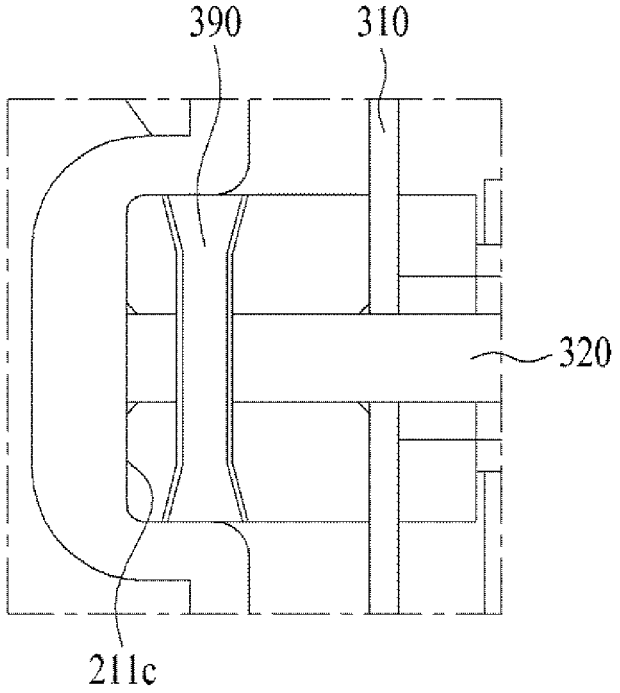

FIG. 9A illustrates a partial longitudinal section of the ice container showing the ice conveyer mounted to the ice container. FIG. 9B illustrates an enlarged view of a "B" portion in FIG. 9A.

That is, the ice container 200 may be formed to surround the spacer 350 with a portion thereof adjacent to the spacer 350 to prevent the pin 390 from falling off the rotational shaft 320. The front plate 211*a* of the ice container 200 may have a recess 211*c* formed at a portion adjacent to the spacer 350 to place a portion of the spacer 350 therein from an inside of the ice container 200. The recess 211*c* may be a projected portion if seen from outside of the ice container 200. Further, the recess 211*c* may have a diameter slightly larger than the spacer 350, with a depth sufficient to receive the pin 390 in the recess 211*c*. By forming the recess 211*c* in the front plate 211*a* of the ice container 200, the falling off of the pin 390 may be prevented more positively, as the pin 390 interferes with the recess 211*c* when the pin 390 is about to fall off the rotational shaft 320 due to an excessive force applied thereto.

Figure 10:
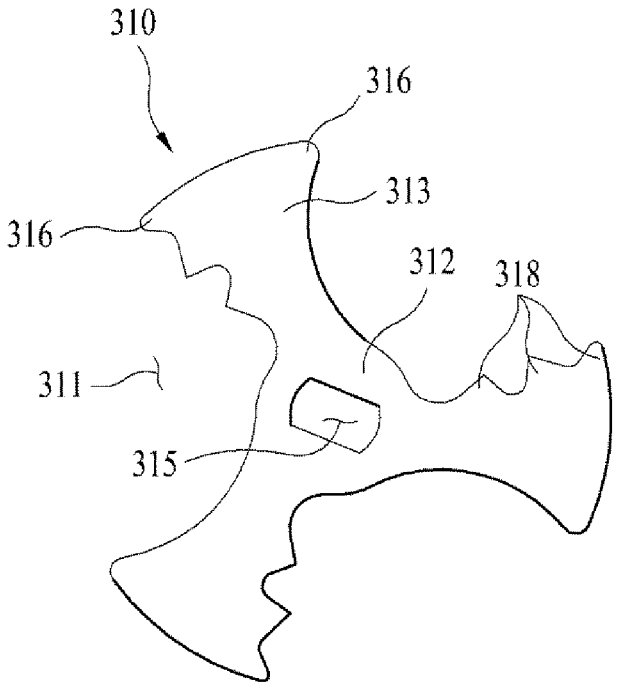
FIG. 10 is a front view of a rotary blade in a refrigerator in accordance with an embodiment.

Referring to FIG. 10, the rotary blades 310 may include a center portion 312, through which the rotational shaft 320 may pass, and a plurality of radial extensions 313 from the center portion 312. The center portion 312 may include pass through hole 315, which may have a long rectangular form, formed therein and through which the rotational shaft 320 may pass therethrough to transmit rotational force to the rotary blades 310.

The radial extensions 313 may be arranged to be spaced from one another to form receiving portions 311, each to receive the ice therein. The extension 313 may have a width that increase as the extension 313 extends toward an outer end portion from the center portion, and a holding portion 316 at a side of the outer end portion of the extension 313 to prevent the ice from falling off the receiving portion 311 or from moving to another receiving portion 311.

Therefore, if the rotary blade 310 rotates in a state in which the ice is received in the receiving portion 311, the ice positioned at the end portion of the extension 313 may be held at or by the holding portion 316 and move in a rotational direction of the rotary blade 310. If the rotary blade 310 moves in a state in which a plurality of ice pieces are positioned near to the holding portion 316, as the holding portion 316 stirs the plurality of ice pieces, the holding portion 316 may prevent the ice pieces from sticking to one another to form a lump.

The extension 313 may have a first side provided with a breaking portion 318, which may have a saw tooth shape, to break the ice, together with the fixed blades 380. The extension 313 may have a second side, which may be an opposite side to the breaking portion 318, having a smooth surface to make the ice move while maintaining the cubic ice state. Thus, within one receiving portion 311, the breaking portion 318 may be positioned at an opposite side to the smooth surface.

Figure 11:
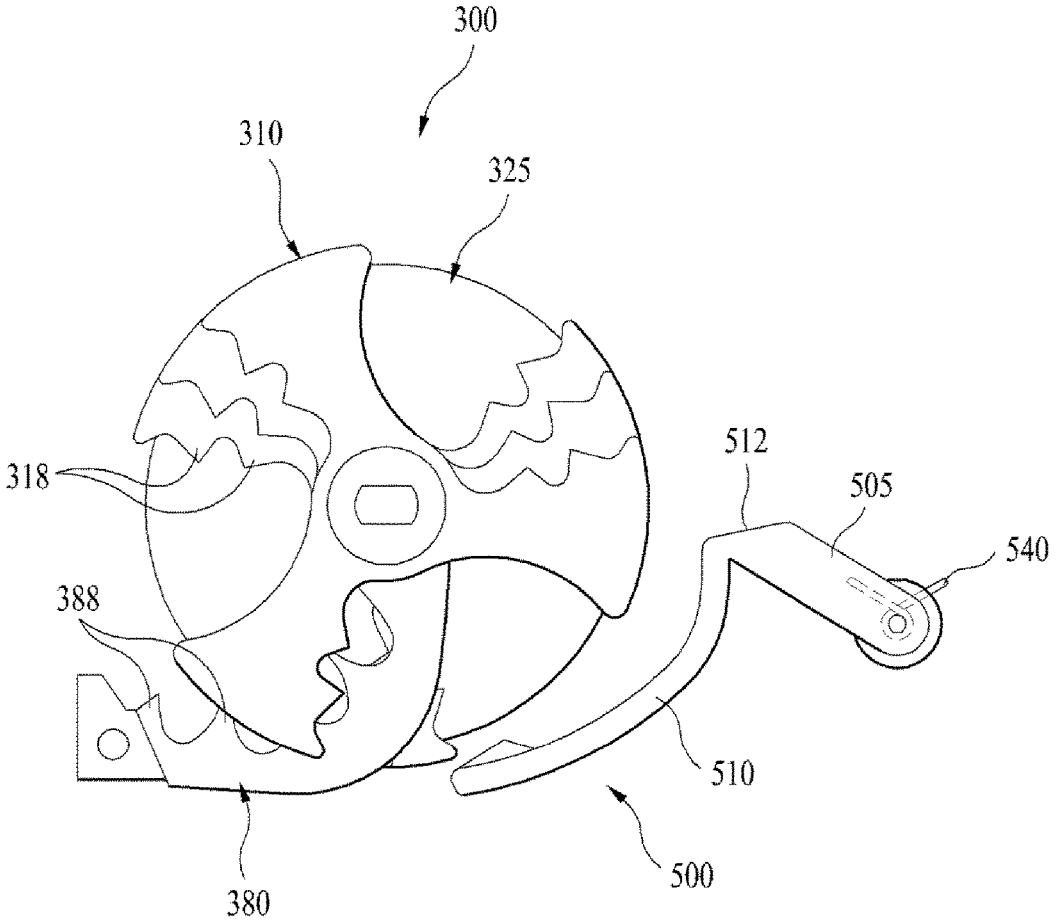
FIG. 11 is a front view of an ice conveyer, fixed blades, and an opening/closing member in a refrigerator in accordance with an embodiment.

Referring to FIG. 11, if the rotary blades 310 are fixedly secured to the rotational shaft 320, the rotary blades 310 may be arranged, not in a line, but slightly twisted as the rotary blades 310 go from a front side to a rear side of the ice conveyer 300. That is, when viewed from the front side, the rotary blades 310 may not overlap perfectly, but rather, each of the rotary blades 310 may be twisted a certain angle from adjacent rotary blades 310. This is because, if the rotary blades 310 are arranged in a line to overlap perfectly, when the rotary blades 310 move toward the fixed blades 380 to break the ice, a pressure being applied to the ice may be dispersed, and breaking of the ice may not to take place as well. However, as described above, if the rotary blades 310 are arranged to be twisted by a certain angle from adjacent rotary blades 310, respectively, after the ice is brought into contact with, and broken by, the breaking portion 318 of the first rotary blade 310, the ice may be brought into contact with the breaking portion 318 of the second rotary blade 310, and the breaking portion 318 of the third rotary blade 310, at fixed time intervals. Eventually, as the rotational force of the ice conveyer 300 may be concentrated on respective breaking portions 318, an ice breaking performance may be enhanced, significantly.

The fixed blade 380 may also be provided with a breaking portion 388 to break the ice. The fixed blade 380 may have a configuration of, for example, an "L" form; however, embodiments are not so limited.

The opening/closing member 500 may be provided on or at one side of the fixed blade 380. The opening/closing member 500 may have a rotary portion 505 rotatably mounted to the ice container 200, provided with an elastic member 540, which may be in the form of a torsion spring, to elastically support the opening/closing member 500. The elastic member 540 may have a first end portion secured to the ice container 200, and a second portion mounted to one side of the opening/closing member 500 to support the opening/closing member 500, elastically. After the opening/closing member 500 is moved by the ice, if the pressure from the ice is removed, the elastic member 540 may lift or return the opening/closing member 500 to an original position.

The opening/closing member 500 may include a first guide surface 510 mounted close to the rotational locus of the rotary blade 310, and a second guide surface 512 connected to both the first guide surface 510 and the rotary portion 505. In such a case, the first guide surface 510 and the second guide surface 512 may be arranged tilted. Further, the second guide surface 512 may form a continuous surface with the second sloped guide surface 222 (see FIG. 2). The first guide surface 510 may be curved in a shape similar to the rotational locus of the rotary blade 310 to guide the ice being discharged.

Figure 12:
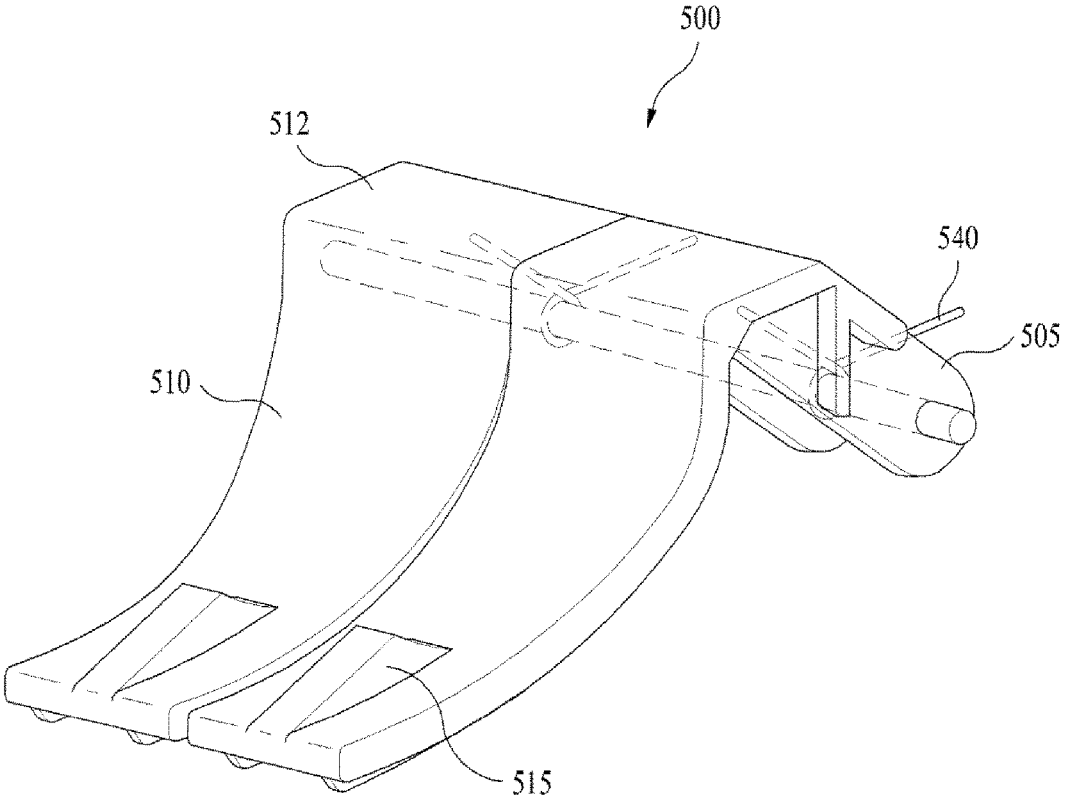
FIG. 12 is a perspective view of an opening/closing member in a refrigerator in accordance with an embodiment.

Referring to FIG. 12, a plurality of the opening/closing members 500 may be provided. The opening/closing members 500 may be movable independent from one another, and mounted such that movement of one of the opening/closing members 500 does not influence movement of the other opening/closing members 500.

The plurality of opening/closing members 500 may be provided to be movable independent from one another for the following reason. If only one opening/closing member 500 is provided, in a case in which an ice cube is not discharged, but remains stagnant at a portion of the first guide surface 510 of the opening/closing member 500 in a state in which the ice cube is positioned on a portion of the opening/closing member 500, other ice cubes may pour down through a gap where ice cubes are not stagnant. Accordingly, even if an ice cube is stagnant at one of the plurality of opening/closing members 500 leaving the opening/closing member 500 in an opened state, as the other opening/closing members 500 may maintain a closed state, unintended discharge of the ice cubes may be prevented. For this reason, the elastic member 540 may be mounted to or provided for each of the plurality of opening/closing members 500.

Each of the opening/closing members 500 may have a holding step 515 to prevent the ice cube seized or caught between the opening/closing member 500 and the rotary blade 310 from discharging to an outside of the ice container 200 when the opening/closing member 500 is closed. The holding step 515 may be provided adjacent to an upper side end of the first guide surface 510.

Figure 13:
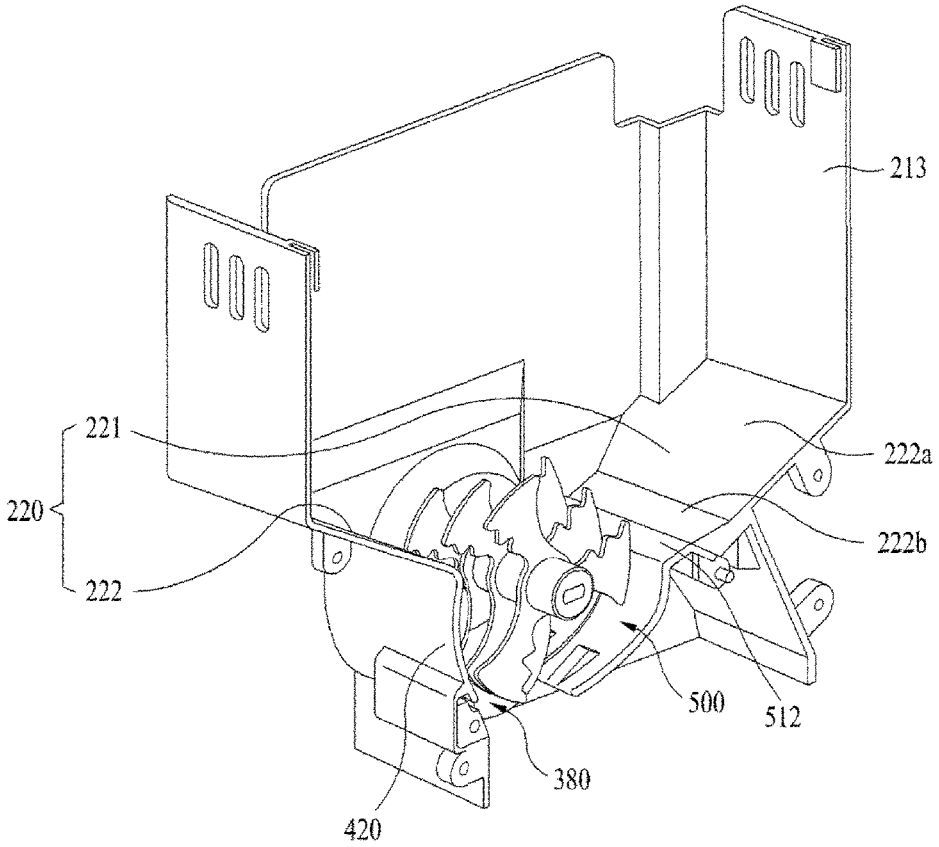
FIG. 13 is a perspective view of an inside of an ice container in a refrigerator in accordance with an embodiment.

Referring to FIG. 13, the first sloped guide surface 221 may be provided adjacent to the fixed blade 380, which breaks the cubic ice, and the second sloped guide surface 222 may be provided adjacent to the opening/closing member 500 through which the cubic ice may be discharged. A discharge guide wall 420, which may extend downward from a slope end point of the first sloped guide surface 221, may be provided to or at one side of the discharge portion 400. The discharge guide wall 420 may be provided higher than a portion to which the end portion of the fixed blade 380 is fixedly secured to guide discharge of the ice without any broken ice remaining. The discharge guide wall 420 may have an outward curve with a predetermined curvature.

The second sloped guide surface 222 may be divided into two portions to adjust a speed of the ice moving on the second sloped guide surface 222 toward the ice conveyer 300 to prevent the cubic ice from breaking. For this reason, the second sloped guide surface may include an outer sloped guide surface 222*a* connected to the side wall 213 of the ice container 200, and an inner sloped guide surface 222*b* provided adjacent to the ice conveyer 300 connected to the outer sloped guide surface 222*a*.

In such a case, the inner sloped guide surface 222*b* may have a degree of slope formed lower than the degree of slope of the outer sloped guide surface 222*a*, such that a moving speed of the ice moved down along the outer sloped guide surface 222*a* may slow down when the ice reaches the inner sloped guide surface 222*b*. The inner sloped guide surface 222*b* may have an end portion provided with the second guide surface 512 of the opening/closing member 500, to form a continuous surface with the inner sloped guide surface 222*b*.

If the opening/closing member 500 closes the discharge opening 410, the second guide surface 512 and the inner sloped guide surface 222*b* may form a continuous surface, serving to drop the moving speed of the ice. If the opening/closing member 500 opens the discharge opening 410, the second guide surface 512 may move down, serving to guide the ice toward the discharge opening 410.

Figure 14:
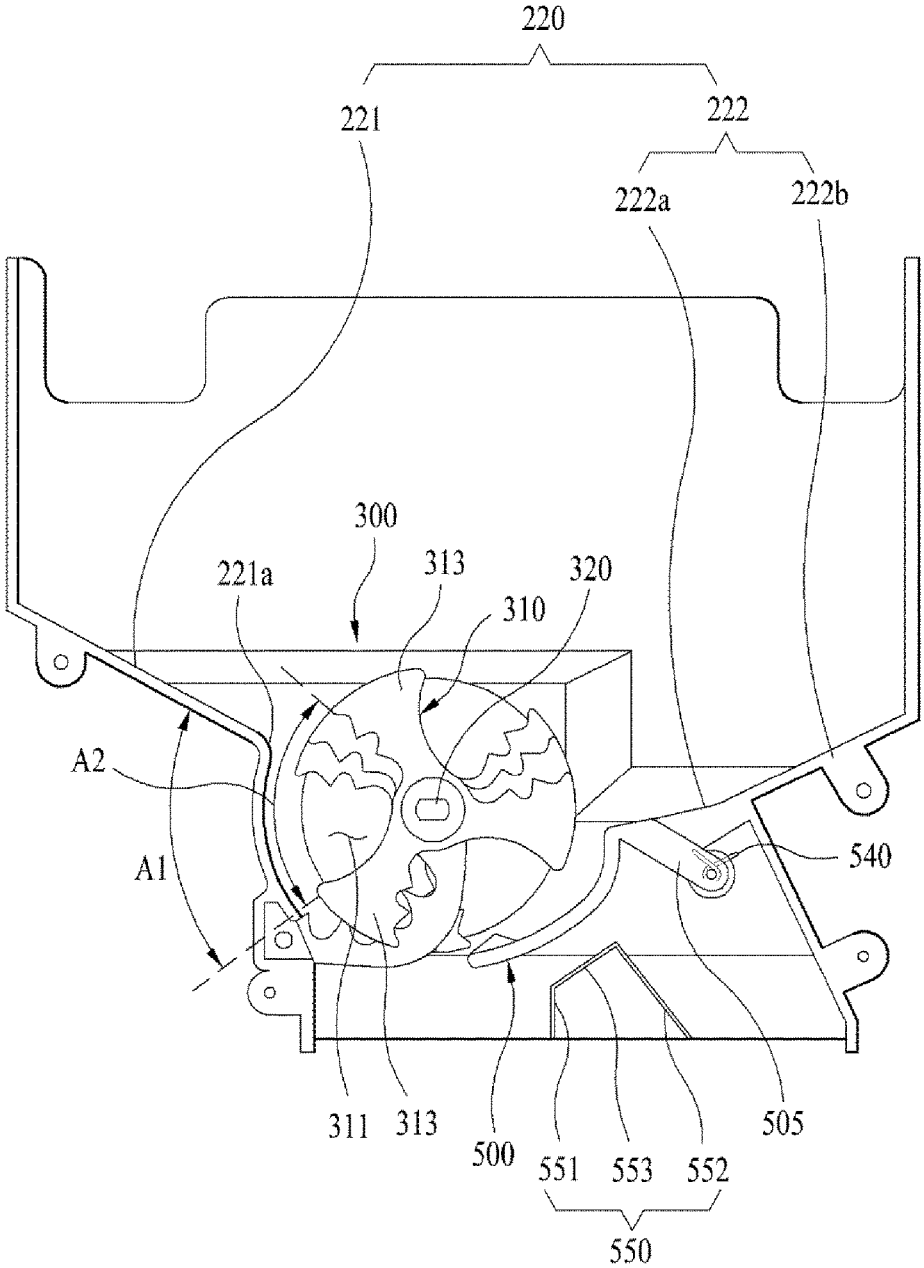
FIG. 14 is a front view of an inside of an ice container in a refrigerator in accordance with an embodiment.

Referring to FIG. 14, a slope end point 221*a* of the first sloped guide surface 221 may be provided higher than a position of the rotational shaft 320 of the ice conveyer 300. This may prevent broken pieces of the ice broken at a point where the fixed blade 380 is positioned from rising to the first sloped guide surface 221.

In order to prevent the broken pieces of ice from being stagnant, the discharge guide wall 420 may have a curvature corresponding to or matched to a curvature of the rotational locus of the rotary blade 310, and an arc A1 of the discharge guide wall 420 may have a length matched to a distance between adjacent extensions 313 of the rotary blade 310, that is, a largest distance A2 of the receiving portion 311. This causes the ice broken and sputtering from the receiving portion 311 to hit the discharge guide wall 420, and therefrom, fall down.

In order to maintain the ice to be in the cubic ice state, the second sloped guide surface 222 may have a degree of slope higher than a degree of slope of the first sloped guide surface 221. In order for the inner sloped guide surface 222*b* of the second slope guide surface 222 and the second guide surface 512 of the opening/closing member 500*a* to form a continuous surface as the degree of slope of the inner sloped guide surface 222*b* and the degree of slope of the second guide surface 512 become substantially the same, and the degree of slope of the second sloped guide surface 222 to be able to be lower than the degree of slope of the first sloped guide surface 221, the rotary portion 505 of the opening/closing member 500 may have a height formed lower than a height of the rotational shaft 320 of the ice conveyer 300. That is, if the height of the rotary portion 505 of the opening/closing member 500 is provided higher than the height of the rotational shaft 320 of the ice conveyer 300, it is required to form the second sloped guide surface 222 steeper than the present configuration, which is against a purpose of dropping the moving speed of the ice. Therefore, if a structural nature is taken into account, in which the rotary portion of the opening/closing member 500 is required to be positioned below the second sloped guide surface 222, the height of the opening/closing member 500 may be positioned lower than the height of the rotational shaft of the ice conveyer 300.

As a too large opening angle of the opening/closing member 500 may cause a problem in that the ice may pour down excessively, it is required to limit the opening angle of the opening/closing member 500. Therefore, the opening limiting portion 550 may be provided under the opening/closing member 500 to limit the opening angle of the opening/closing member 500.

Further, the opening limiting portion 550 may include a first rib 551 provided extending in a substantially vertical direction, a second rib 552 arranged spaced from the first rib 551 to have a height higher than the first rib, and a contact portion 553 connected at a tilt between a top end of the first rib 551 and a top end of the second rib 552 to bring the opening/closing member 500 into contact thereto. In such a case, as the opening/closing member 500 may be brought into contact with the contact portion 553, the opening angle may be limited.

Figure 15:
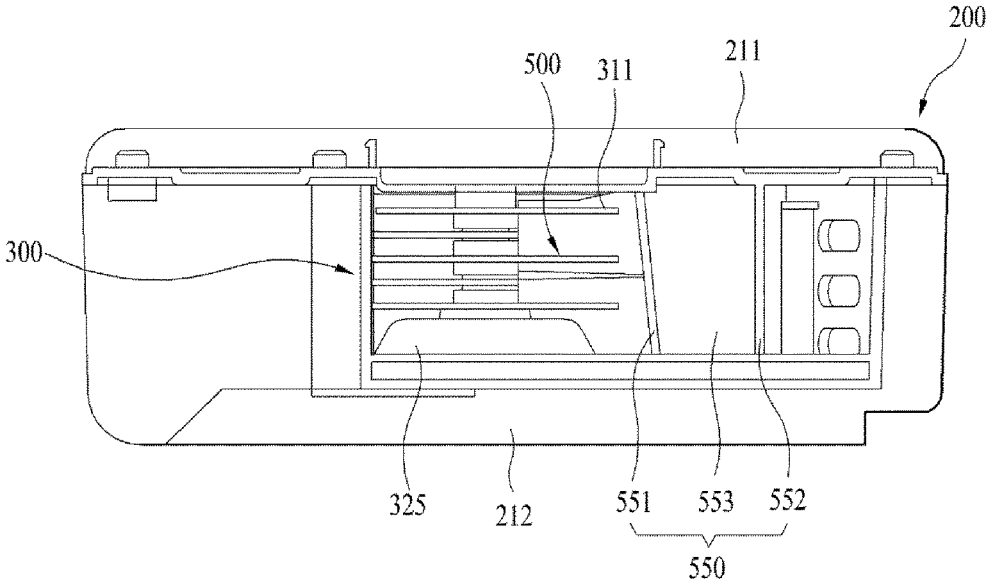
FIG. 15 is a bottom view of an ice container in a refrigerator in accordance with an embodiment.

As described above, the plurality of the opening/closing members 500 may be provided, and in addition to this, the opening/closing members 500 may have largest opening angles different from one another. This is because, as the rotary blades 310 are arranged to be twisted from one another slightly, such that the receiving portion 311 of one rotary blade 310 is twisted from the receiving portion of another rotary blade 310, the opening/closing members 500 may have largest opening angles different from one another. That is, referring to FIG. 15 illustrating a bottom view of the ice container, a bottom view of the opening limiting portion 550 is shown. A lower side of the ice container 200 in the drawing may be a rear side of the ice container, and an upper side of the ice container in the drawing may be a front side of the ice container 200. Two opening/closing members 500 are shown and configured to move independently.

The first rib 551 is slanted such that, as the first rib 551 extends from the rear side to the front side of the ice container 200, the first rib 551 may extend toward a center of the ice container. According to this, an area through which the ice may be discharged becomes larger as the ice container extends from the front side thereof to the rear side thereof.

Of the opening/closing members 500 arranged in the ice container 200, the opening/closing member 500 arranged on or at the front side has a rotational angle smaller than a rotational angle of the opening/closing member 500 arranged on or at the rear side. As described above, such a configuration of the first rib 551 is a reflection of the plurality of the rotary blades being arranged, not perfectly in a line, but twisted from one another, slightly.

Figure 16:
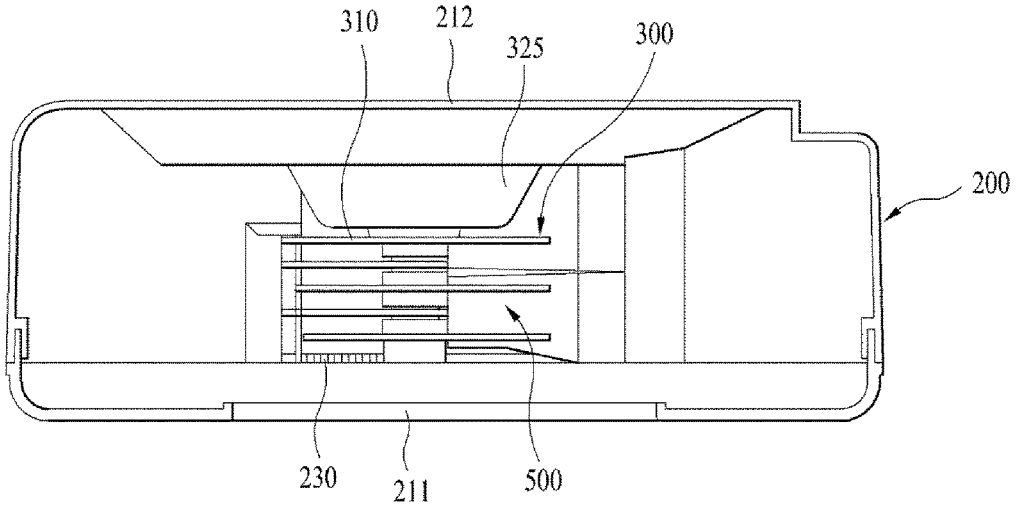
FIG. 16 is a plan view of an ice container in a refrigerator in accordance with an embodiment.

FIG. 16 is a plan view of an ice container in a refrigerator in accordance with an embodiment. The ice container 200 of FIG. 16 may include an ice seizure preventive portion 230 on an inside of the front 211. The ice seizure preventive portion 230 may project or extend from an inside of the front 211 of the ice container 200 toward an inner side of the ice container 200 to occupy a substantial portion of a space between a front-most rotary blade of the plurality of the rotary blades 310 and the inside of the front 211 of the ice container 200. The ice seizure preventive portion 230 may be provided over a side of the ice container 200 where the broken ice pieces are to be discharged.

As a side of the ice container 200 through which the cubic ice is to be discharged may have a size of the space between the rotary blade 310 and the front 211 of the ice container 200, which is very small compared to a size of the cubic ice, the cubic ice may not be seized in the space. However, the broken ice pieces may have a size similar to a size of the space between the rotary blade 310 and the front 211 of the ice container 200 at a side of the ice container 200 through which the broken ice pieces are to be discharged, allowing the broken ice pieces to be seized in the space causing trouble for rotation of the rotary blade 310, consequently. Eventually, occurrence of the trouble may be prevented in advance by providing the ice seizure preventive portion 230.

Operation of an ice container according to embodiments will be described with reference to the attached drawings.

Figure 17:
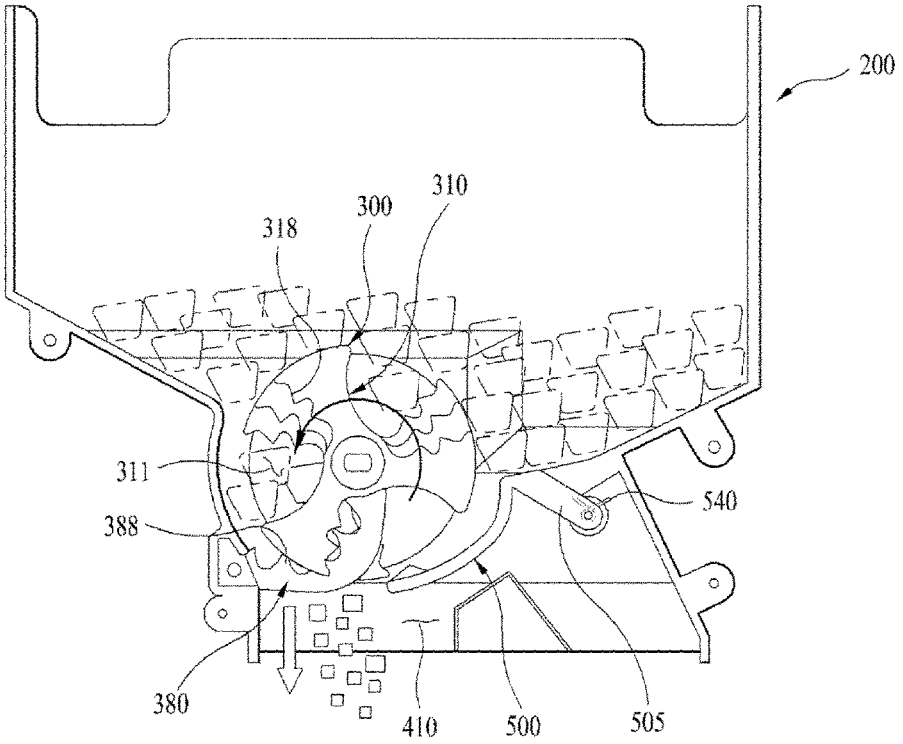
FIG. 17 is a front view showing broken ice pieces being discharged from an ice container in a refrigerator in accordance with an embodiment.

Referring to FIG. 17, in a case in which a user wants broken ice pieces, if the user gives an order to dispense the broken ice pieces, the ice conveyer 300 may rotate in a first rotational direction. Then, the breaking portion 318 of the rotary blades 310 may come closer to the breaking portion 388 of the fixed blade 380, gradually. According to this, the ice may be transferred from the receiving portion 311 of the rotary blade 310 to the fixed blade 380 as the rotary blade 310 rotates.

In such a state, if the rotary blade 310 rotates further, the ice placed between breaking portion 318 of the rotary blades 310 and the breaking portion 388 of the fixed blade 380 may be broken into the broken ice pieces, and therefrom, drop toward the discharge opening 410 and may be discharged to an outside of the ice container 200. In a case that the broken ice pieces are discharged, as the opening/closing member 500 maintains a closed state, the cubic ice may be prevented from dropping down.

Figure 18:
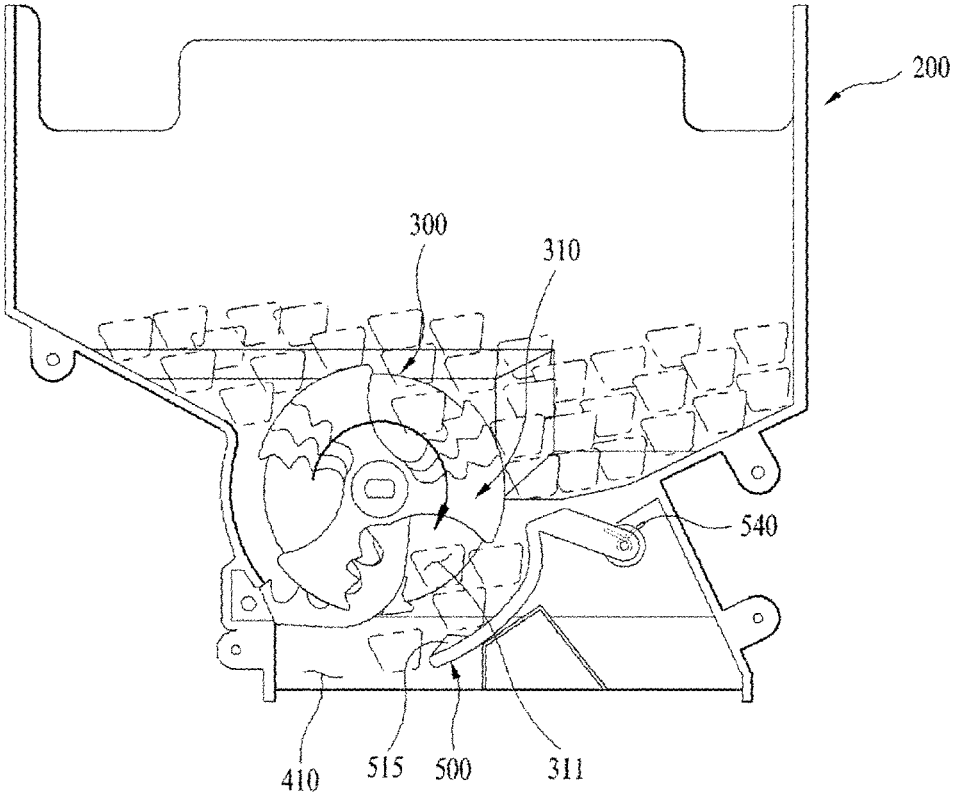
FIG. 18 is a front view showing cubic ice being discharged from an ice container in a refrigerator in accordance with an embodiment.

Referring to FIG. 18, if the user gives an order to dispense the cubic ice, that is, for the ice conveyer 300 to discharge the ice in the cubic ice state, the ice conveyer 300 may rotate in the second rotational direction. In this case, the ice may be conveyed from the receiving portion 311 of the rotary blade 310 toward the opening/closing member 500 as the rotary blade 310 rotates. In this state, if the rotary blade 310 keeps rotating, the extension 313 of the rotary blade 310 may press down the ice placed on the opening/closing member 500.

In this case, pressure applied to the ice from the rotary blade 310 may be transmitted to the opening/closing member 500 through the ice. Due to the pressure applied by the rotary blade 310 through the ice, the opening/closing member 500 may rotate downward, to form a predetermined gap between the end portion of the extension 313 of the rotary blade 310 and the end portion of the opening/closing member 500. The cubic ice may be discharged through the gap. The opening angle of the opening/closing member 500 may increase, not infinitely, but may be limited as an underside of the opening/closing member 500 is brought into contact with the opening limiting portion 550, thereby preventing excessive discharge of the cubic ice. If a predetermined amount of the ice is discharged, the ice conveyer 300 may stop rotation, making the pressure applied to the ice from the rotary blade 310 disappear. If the pressure disappears, the opening/closing member 500 may return to the original position by the elastic force of the elastic member 540, to a position adjacent to the end portion of the extension 313 of the rotary blade 310. In this case, movement of the ice toward the discharge opening may be prevented.

If ice exists between the rotary blade 310 and the opening/closing member 500, as the holding step 515 of the opening/closing member 500 holds the ice, the ice may be prevented from dropping toward the discharge opening 410.

The refrigerator with an ice container according to embodiments may have at least the following advantages.

As no additional element like an auger which forcibly transfers the ice to the ice conveyer is required, the transfer of the ice to the ice conveyer by gravity may simplify an inside configuration of the ice container. Further, the vertical direction transfer of the ice in most of the cases may shorten a transfer distance, and may permit to contribute to manufacture a slim refrigerator.

As the rotary blades and the fixed blades, and the spacers provided therebetween, respectively, mounted to the rotational shaft of the ice conveyer may be fixedly secured with the pin fixedly secured to pass through the spacer and the rotational shaft, axial direction movement of the blades may be prevented. As the pin may be a spring pin expanded after the pin is inserted in the spacer, unfastening of the rotational shaft may be prevented even if the rotational shaft of the ice conveyer reverses a rotational direction repeatedly when the ice container in the refrigerator is used.

Embodiments disclosed herein provide a refrigerator which enables to shorten a conveyance distance of ice from an ice container, and to reduce a front/rear direction width of the ice container to allow a thickness of a refrigerator to be slimmer. Embodiments disclosed herein further provide a refrigerator which enhances a user's convenience by dispensing ice in a cubic state or a broken state according to a user's selection, and simplifies an inside structure by transferring the ice automatically by gravity up to a point before dispensing of the ice without any additional transfer device. Embodiments disclosed herein provide a refrigerator which prevents a rotational shaft of an ice conveyer from unfastening even if the rotational shaft reverses a rotational direction thereof repeatedly at a time a user uses an ice container in a refrigerator.

Embodiments disclosed herein further provide a refrigerator that may include a body having a storage chamber, a door rotatably mounted to the body to open/close the storage chamber, an ice container detachably mounted to the door or the body, a discharge portion provided in the ice container to have a discharge opening to discharge the ice, and an ice conveyer reversibly mounted in the ice container to discharge the ice moved by gravity in a cubic ice state or a broken ice state, selectively. The ice conveyer may include a rotational shaft connected to a reversible motor to reverse a rotational direction thereof selectively, a plurality of rotary blades mounted to the rotational shaft, a plurality of fixed blades each mounted between adjacent rotary blades to apply a pressure to the ice together with the rotary blades to break the ice when the rotary blades rotate in a first direction, spacers coupled to the rotational shaft to fixedly secure the rotary blades at predetermined positions, respectively, and a pin inserted in a pass through hole in an end portion of the rotational shaft and a pass through hole in the spacer coupled to the end portion by press fitting to secure the rotary blades and the fixed blades to the rotational shaft.

The pin may be a spring pin having a side with a lengthwise direction incision. The pin may have two end portions pressed by a press to expand the ends after the pin is inserted in, and passed through, the rotational shaft and the spacer. The pass through holes in the spacer, through which the pin may to be inserted, may have countersinks, respectively. The pin may be inserted in the pass through holes in the rotational shaft and the spacer in a state in which the spacer is coupled to the rotational shaft together with the plurality of rotary blades and the plurality of fixed blades, and a jig in the press, on which the spacer is to be seated, may have a hole formed therein and the spacer may have a projection formed corresponding to or matched to the hole to prevent the spacer from rotating when the pin is being inserted into the spacer.

The ice container may be constructed to have a configuration in which a portion of the ice container adjacent to the spacer surrounds a portion of the spacer to prevent the pin from falling off the rotational shaft. The plurality of the rotary blades and the plurality of fixed blades may be arranged spaced from one another by a plurality of the spacers, each arranged between adjacent blades inserted on the rotational shaft.

The ice conveyer may further include a supporting plate mounted at a rear of the plurality of rotary blades to place the rotational shaft therein. The ice conveyer may further include an opening/closing member provided on one side of the discharge opening to which the ice being discharged by the rotary blade may be brought into contact to have the pressure applied thereto to open or close the discharge opening selectively, when the rotary blade rotates in a second direction. The supporting plate may have a sloped side for the ice to slide therefrom toward the rotary blade.

The motor may be mounted to one side of the ice container to reverse the rotational shaft selectively, and the ice conveyer may further include a connection plate mounted to the rotational shaft in a rear of the supporting plate to transmit a driving force from the motor to the ice conveyer, as the connection plate is detachably connected to the motor, and an elastic member mounted between the supporting plate and the connection plate to support the connection plate elastically to connect the connection plate to the motor to transmit power to the ice conveyer.

The rotary blade may include a center portion having the rotational shaft fixedly secured thereto, at least two extensions that extend from the center portion in a radial direction, holding portions at both end portions of the extension to hold the ice, and a plurality of breaking portions having saw tooth shapes provided to one side of the extension to be provided into contact with the ice to break the ice. The rotary blade may further include a receiving portion which is a space formed between adjacent extensions to receive the ice therein. The extension may have a width which becomes the larger as the extension extends to an outer side thereof in the radial direction. The fixed blade may have one end mounted to the rotational shaft and the other end fixedly secured to a side wall of the discharge portion, and one side provided with saw tooth shaped breaking portions. The plurality of rotary blades may be arranged at angles twisted from one another.

The ice container may further include a discharge guide wall provided to one side of the discharge portion where the fixed blade is provided thereto in a shape corresponding to or matched to a rotational locus of the rotary blade to space broken ice a certain distance from the end portion of the extension of the rotary blade to prevent the ice from being stagnant in the discharge portion.

The ice container may further include an ice seizure preventive portion projected toward the rotary blade from a rear side of a front wall of the ice container to prevent the ice from being seized to become stagnant between the rotary blade and the ice container. The ice container may further include a sloped guide surface provided to or at both sides of the rotary blade in the ice container to have a slope to guide the ice toward the rotary blades. The sloped guide surface may include a first sloped guide surface provided to one side of the rotary blades, and a second slope guide surface provided to the other side of the rotary blade. The first sloped guide surface may be mounted close to the fixed blades, and the second sloped guide surface may be mounted close to the opening/closing member. The first sloped guide surface may have a slope end point provided higher than a height of the rotational shaft of the rotary blade to prevent the ice broken by the rotary blade and the fixed blade from moving to the first sloped guide surface.

It is to be understood that both the foregoing general description and the detailed description of embodiments are exemplary and explanatory and are intended to provide further explanation as claimed. It will be apparent to those skilled in the art that various modifications and variations can be made without departing from the spirit or scope. Thus, it is intended that embodiments cover the modifications and variations provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a body having at least one storage chamber;

at least one door rotatably mounted to the body to open or close the at least one storage chamber;

an ice container detachably mounted to the at least one door or the body, the ice container including:

a discharge passage provided in the ice container and having a discharge opening to discharge ice; and an ice conveyer mounted in the ice container to discharge the ice moved by gravity as ice cubes or broken ice, selectively, wherein the ice conveyer includes:

a rotational shaft connected to a motor;

a plurality of rotary blades mounted to the rotational shaft;

a plurality of fixed blades that are each mounted between adjacent pairs of the rotary blades to apply a pressure to the ice together with the plurality of rotary blades to break the ice when the plurality of rotary blades rotates in a first direction;

a plurality of spacers coupled to the rotational shaft to fixedly secure the plurality of rotary blades at predetermined positions, respectively; and a pin configured to be inserted in a first hole formed in an end of the rotational shaft and in a second hole formed in a spacer of the plurality of spacers coupled to the end by press fitting to secure the plurality of rotary blades and the plurality of fixed blades to the rotational shaft, wherein the rotational shaft includes a non-circular shank having a first flat surface and a second flat surface that is opposite to the first flat surface, and the first hole passes through the first flat surface and the second flat surface.

2. The refrigerator of claim 1, wherein the first flat surface is parallel to the second flat surface.

3. The refrigerator of claim 1, wherein the spacer includes a front surface and an opposite rear surface that faces one of the plurality of rotary blades, wherein a distance between the rear surface and the second hole is greater than another distance between the front surface and the second hole.

4. The refrigerator of claim 1, wherein the pin is a spring pin having a lengthwise incision, and wherein axial ends of the pin are configured to receive a force from a press to expand the axial ends after the pin is inserted into the second hole of the spacer and passes through the rotational shaft.

5. The refrigerator of claim 1, wherein a top and a bottom of the second hole in the spacer, into which the pin is inserted, have countersinks, respectively.

* * * * *